US007892418B2

(12) United States Patent
Agha

(10) Patent No.: US 7,892,418 B2
(45) Date of Patent: Feb. 22, 2011

(54) PROCESS FOR PRODUCING LOW SULFUR AND HIGH CETANE NUMBER PETROLEUM FUEL

(75) Inventor: Hassan Agha, Damascus (SY)

(73) Assignee: Oil Tech SARL, Beirut (LB)

( * ) Notice: Subject to any disclaimer, the term of this patent is extended or adjusted under 35 U.S.C. 154(b) by 55 days.

(21) Appl. No.: 12/454,896

(22) Filed: May 26, 2009

(65) Prior Publication Data

US 2009/0288982 A1 Nov. 26, 2009

Related U.S. Application Data

(63) Continuation of application No. 11/102,867, filed on Apr. 11, 2005, now abandoned.

(51) Int. Cl.
*C10L 1/04* (2006.01)
*C10G 17/02* (2006.01)

(52) U.S. Cl. ..... 208/219; 208/15; 208/223; 208/224; 208/225; 208/226; 208/230; 208/248

(58) Field of Classification Search ..... 208/15, 208/219, 223–226, 230, 248
See application file for complete search history.

(56) References Cited

U.S. PATENT DOCUMENTS

| | | | | | |
|---|---|---|---|---|---|
| 1,930,216 | A | * | 10/1933 | Weber | 208/230 |
| 2,420,218 | A | * | 5/1947 | Ayers | 208/214 |
| 3,011,967 | A | | 12/1961 | Schmitkons et al. | |
| 3,347,779 | A | | 10/1967 | Groenendaal et al. | |
| 3,471,399 | A | | 10/1969 | O'Hara | |
| 3,573,198 | A | | 3/1971 | Parker et al. | |
| 3,594,307 | A | | 7/1971 | Kirk, Jr. | |
| 3,607,729 | A | | 9/1971 | Robinson et al. | |
| 3,639,227 | A | | 2/1972 | Jacobson et al. | |
| 3,775,291 | A | | 11/1973 | Sze | |
| 3,876,532 | A | | 4/1975 | Plundo et al. | |
| 3,985,638 | A | | 10/1976 | Kirk, Jr. | |
| 4,002,558 | A | | 1/1977 | Feldman | |
| 4,024,947 | A | | 5/1977 | Knolle | |
| 4,101,643 | A | | 7/1978 | Tung | |
| 4,179,361 | A | | 12/1979 | Michlmayr | |
| 4,332,666 | A | | 6/1982 | Bauman et al. | |
| 4,392,947 | A | | 7/1983 | Audeh et al. | |
| 4,409,092 | A | | 10/1983 | Johnson et al. | |
| 4,634,516 | A | | 1/1987 | Haskell et al. | |
| 4,645,585 | A | | 2/1987 | White | |
| 4,717,465 | A | | 1/1988 | Chen et al. | |
| 4,875,992 | A | | 10/1989 | Hamner | |
| 5,611,914 | A | | 3/1997 | Prince et al. | |
| 5,723,039 | A | * | 3/1998 | Zosimov et al. | 205/696 |
| 5,858,212 | A | | 1/1999 | Darcy | |
| 5,951,851 | A | | 9/1999 | Poirier et al. | |
| 5,954,941 | A | | 9/1999 | Mercier et al. | |
| 6,368,495 | B1 | | 4/2002 | Kocal et al. | |
| 6,669,743 | B2 | | 12/2003 | Wittenbrink et al. | |
| 6,858,048 | B1 | | 2/2005 | Jimeson et al. | |
| 7,223,332 | B1 | | 5/2007 | Tertel | |
| 7,238,277 | B2 | | 7/2007 | Dahlberg et al. | |
| 7,250,107 | B2 | | 7/2007 | Benazzi et al. | |
| 7,285,140 | B2 | | 10/2007 | Valentine | |
| 7,311,814 | B2 | | 12/2007 | Guyomar et al. | |
| 7,354,507 | B2 | | 4/2008 | Gopalakrishnan et al. | |
| 2005/0145539 | A1 | | 7/2005 | Shibuya et al. | |
| 2006/0011518 | A1 | | 1/2006 | Feimer | |
| 2006/0118468 | A1 | | 6/2006 | Feimer | |
| 2008/0092829 | A1 | | 4/2008 | Renninger et al. | |

FOREIGN PATENT DOCUMENTS

| | | |
|---|---|---|
| WO | WO 0210317 | 2/2002 |
| WO | WO 2004035714 | 4/2004 |
| WO | WO 2004076599 | 9/2004 |
| WO | WO 2006099573 | 9/2006 |
| WO | WO 2007043738 | 4/2007 |

* cited by examiner

*Primary Examiner*—Cephia D Toomer
(74) *Attorney, Agent, or Firm*—Law Offices of Martin Jerisat

(57) ABSTRACT

The present invention relates to a process for reducing sulfur content in petroleum fuel, such as diesel fuel, and raising the Cetane Number to a value above 50.

11 Claims, No Drawings

PROCESS FOR PRODUCING LOW SULFUR AND HIGH CETANE NUMBER PETROLEUM FUEL

This application is a continuation of U.S. patent application Ser. No. 11/102,867, filed Apr. 11, 2005, now abandoned.

FIELD OF THE INVENTION

The present invention relates to a process for reducing sulfur content in petroleum fuel, such as diesel fuel, and raising the Cetane Number to a value above 50.

BACKGROUND OF THE INVENTION

Several states as well as certain European nations have increasingly brought about stricter requirements for the sulfur content of petroleum fuel. Aside from reducing corrosion in engines, lower sulfur provides for cleaner air with reduced toxicity to human life. An example of the potential danger from air polluted with sulfur is the formation of acid rain from oxidized forms of sulfur.

Hydrodesulfurization is a catalytic chemical process used worldwide to remove sulfur from refined petroleum products. The process is carried out at elevated temperatures ranging from 300 to 400° C. with elevated pressures ranging from 30 to 130 atmospheres. A catalyst is usually employed and comprises an inert substrate containing cobalt and molybdenum. Prior to exposure to the catalyst, the sulfur rich feed is joined by a stream of hydrogen rich gas. In a typical reaction, ethyl mercaptan is converted to the hydrocarbon ethane plus hydrogen sulfide. Other organic sulfur containing compounds such as sulfides, disulfides, thiophene and thiophene derivatives are also converted to the corresponding hydrocarbon plus hydrogen sulfide, which is subsequently converted into elemental sulfur. Most of the sulfur produced worldwide is by-product sulfur from this refinery process.

Modification of the hydrodesulfurization process had been reported in the literature. For example, U.S. Pat. No. 5,770,047 to Salazar, et al. discloses a process for reducing sulfur content by 30 to 60%. The process requires the introduction of hydrogen gas at high temperatures in the range of 280 to 320° C. with best results achieved at a pressure of 400 psig. A special catalyst of Group III or Group VI metals impregnated within in a high surface area inert support was also required.

U.S. Pat. No. 8,062,322 to Schmidt discloses that desulfurization of sulfur containing fuels by a pyrolysis method conducted at a temperature of between 600° and 900° C. in the presence of a finely divided metal such as iron powder.

U.S. Pat. No. 480,885,662 to Mead discloses a process for producing low sulfur petroleum fuel. The process comprises the steps of contacting the fuel with an oxygen containing gas, mixing the fuel with acid and then neutralizing the acid with the base. The process requires temperatures of about 400° to 675° F.

The current state of the technology for desulfurization of petroleum fuel requires extremely high temperatures and pressures that require highly engineered, special equipment. Storage facilities and delivery equipment for hydrogen gas are often required components.

Sulfur continues to be a major offender in the pollution of air through the burning of fossil fuels. As concerns for the burning of fossil fuels is heightened among the major industrial countries of the world, sulfur continues to be a most undesirable component of fossil fuel burning, and consequently, permissible levels continue to be reduced.

There is a continuing need for new methods and alternate approaches for removing sulfur from petroleum fuel, and, in particular, manufacturers seek methods that are relatively simple, have low capital investment costs and are highly effective. The present invention meets or exceeds these needs.

SUMMARY OF THE INVENTION

In one aspect, the present invention provides a process for producing low sulfur petroleum fuel. The process includes the steps of providing a petroleum fuel having a predetermined sulfur content and a predetermined Cetane Number, adding an aqueous acid solution to said fuel, adding aluminum metal to said fuel, mixing the petroleum fuel, acid solution and aluminum metal, adding sufficient aqueous base at a temperature of 100 to 120° C. to neutralize said acid, and, allowing said petroleum fuel to separate from the aqueous solution.

The petroleum fuel, which is the starting material in the process described above, has a predetermined sulfur content of from between 20 ppm and 2000 ppm. Typically sweet crude oil from which petroleum fuel may be derived has a sulfur content of as much as 0.5% or 5000 ppm. During the petroleum refining steps, such as reforming, which lead to petroleum fuel the sulfur content is substantially reduced.

Furthermore, the Cetane Number of the petroleum fuel employed as the starting material in the present invention is generally at least 40. The Cetane Number enhancing additive raises the cetane number to a value of at least 50.

In a preferred embodiment of the present invention, the process steps recited in claim 1 are carried out at one atmosphere of pressure.

In another preferred embodiment of the present invention, the sulfur content of the starting material petroleum fuel is reduced by at least 50%.

In a preferred embodiment, the aluminum is in the form of powder, chips or filings or any combination thereof.

In another preferred embodiment, the aqueous acid is selected from the group consisting of sulfuric acid, HCl, phosphoric acid and mixtures thereof.

In a preferred embodiment, the aqueous base used to neutralize the acid is selected from the group consisting of sodium hydroxide, potassium hydroxide, ammonium hydroxide, sodium carbonate and sodium bicarbonate.

In another embodiment of the present invention, the sulfur reduction process is followed by the addition of the Cetane Number elevating additive selected from the group consisting of alcohols, alkyl esters of inorganic acids and peroxides.

DETAILED DESCRIPTION OF THE INVENTION

Petroleum diesel fuel is produced from the fractional distillation of crude oil between 200° C. and 350° C. at atmospheric pressure, resulting in a mixture of hydrocarbons containing between 8 and 21 carbon atoms per molecule and being 75% saturated and 25% aromatic. The sulfur found in diesel fuel is normally present as alkyl sulfides, alkyl disulfides, thiophene and thiophene derivatives along with hydrogen sulfide gas. In the present invention, these sulfur compounds are exposed to hydrogen gas under conditions that convert organic sulfur compounds to hydrogen sulfide gas that is removed as an off-gas at elevated temperatures.

In the present invention, effective amounts of sulfuric acid is employed so that all of the aluminum is converted to the water-soluble salt aluminum sulfate according to Scheme 1 below:

$$2Al+3H_2SO_4 \rightarrow 3H_2+Al_2SO_4 \quad \text{Scheme 1}$$

The hydrogen produced in Scheme 1 reacts with the sulfur compounds resulting in the cleavage of the carbon-sulfur chemical bond. The net result is the formation of carbon-hydrogen and hydrogen-sulfur chemical bonds.

In Scheme 2 below ethyl mercaptan, a typical sulfur compound present in petroleum fuel, is desulfurized resulting in the formation of the hydrocarbon and hydrogen sulfide that is readily removed from the reaction mixture under elevated temperatures.

$$C_2H_5SH+H_2 \rightarrow C_2H_6+H_2S \quad \text{Scheme 2}$$

While not wishing to be bound by theory, the inventor believes that the hydrogenation step of the present invention is fast and highly efficient because the sulfur compounds are initially adsorbed onto the aluminum metal surface whereupon hydrogen gas is liberated in direct and close proximity to the sulfur compound.

Cetane Number is a measure of the ignition quality of diesel fuel. It is not a measure of overall fuel quality, but rather is a measure of the fuels ignition delay that is the time between the start of injection and start of fuel combustion. Generally, higher cetane fuels will have shorter ignition delay than lower cetane fuels.

Low Cetane Numbers will likely cause hard starting, rough operations, noise and exhaust smoke. Generally, diesel engines will operate better on fuels with cetane numbers above 50 as compared to fuels with lower cetane numbers of approximately 45 that represents the United States national average.

Diesel fuels are blend of distillate fuels and cracked petroleum hydrocarbons. The cracked hydrocarbons are low in cetane number due to high aromatic content. To meet the cetane Number demands of most diesel engines, cetane improvers are added to the blend.

Cetane improvers modify fuel combustion in the engine. They encourage early and uniform ignition of the fuel. Typically alkyl nitrate additives can increase cetane by about 3 to 5 numbers. Most cetane improvers contain alkyl nitrates that break down providing additional oxygen for better combustion.

EXPERIMENTAL

The present invention is a process carried out preferably in two phases. The first phase includes receiving petroleum fuel to be treated. The fuel temperature is preferably 80 to 100° C. The fuel is then mixed with an aqueous solution of sulfuric acid followed by the addition of elemental aluminum. Generally this step is carried out at atmospheric pressure. This phase may take 10 hours depending on the incoming level of sulfur fuel and the quantity of fuel being treated.

In the second phase, the fuel is mixed with an aqueous solution of base to neutralize unreacted acid. The reaction mixture is heated to a temperature of about 100° C. and mixing its continued for 3 to 4 hours. As a next step, the resulting fuel is sent to a separator where the fuel naturally separates from the water phase.

An additional step is employed to raise the Cetane Number. At least one additive is added to the fuel. The additive is preferably an alcohol such as methanol, an alkyl esters of inorganic acids such as alkyl nitrates, butyl nitrates, amyl nitrates, isobutyl nitrate or a peroxides or combinations thereof.

The process reduces sulfur content by at least 50% and raises the Cetane Number to a value higher than 50.

The present process is a simple and inexpensive treatment of petroleum fuel to improve its ignition quality and provide cleaner fuels.

While the invention has been described in detail with reference to specific embodiments thereof, it will be apparent to one skilled in the art that various changes and modifications can be made therein without departing from the scope and spirit thereof. Although the present invention has been described herein with reference to particular means, materials and embodiments, the present invention is not intended to be limited to the particulars disclosed herein; rather, the present invention extends to all functionally equivalent structures, methods and uses, such as those within the scope of one with average skill in the art.

What is claimed is:

1. A process for producing low sulfur petroleum fuel, said process comprising the steps of:

a. providing a petroleum fuel having a predetermined sulfur content and a predetermined Cetane Number;

b. adding an aqueous acid solution to said fuel;

c. adding aluminum metal to said fuel;

d. mixing the petroleum fuel, acid solution and aluminum metal;

e. adding effective amounts of aqueous base to neutralize said acid; and f. allowing said petroleum fuel to separate from the aqueous solution.

2. The process according to claim 1 further comprising the step of adding at least one Cetane Number elevating additive selected from the group consisting of alcohols, alkyl esters of inorganic acids, and peroxides.

3. The process according to claim 1 wherein said petroleum fuel has a predetermined sulfur content in the range of 50 ppm to 2000 ppm.

4. The process according to claim 3 wherein said sulfur content is reduced by 30 to 60%.

5. The process according to claim 1 wherein said aluminum metal is selected from the group consisting of aluminum powder, aluminum chips and aluminum filings and any combination thereof.

6. The process according to claim 1 wherein said aqueous acid is selected from the group consisting of sulfuric acid, HCl and phosphoric acid.

7. The process according to claim 1 wherein said aqueous base is selected from the group consisting of sodium hydroxide, potassium hydroxide, ammonium hydroxide, sodium carbonate and sodium bicarbonate.

8. The process according to claim 1 wherein said predetermined Cetane Number is in the range of 30 to 50.

9. The process according to claim 2 wherein said Cetane Number elevating additive raises the cetane number to a value above 50.

10. The process according to claim 1 wherein said process steps are carried out at a pressure of one atmosphere.

11. The process according to claim 1 wherein said petroleum fuel is diesel fuel.

* * * * *